US007874973B2

(12) United States Patent
Akatsu et al.

(10) Patent No.: US 7,874,973 B2
(45) Date of Patent: Jan. 25, 2011

(54) CENTRIFUGE WITH STEAM STERILIZATION

(75) Inventors: Katsunori Akatsu, Ibaraki (JP); Masaharu Aizawa, Ibaraki (JP); Tatsuya Konno, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 171 days.

(21) Appl. No.: 12/130,041

(22) Filed: May 30, 2008

(65) Prior Publication Data

US 2008/0300124 A1 Dec. 4, 2008

(30) Foreign Application Priority Data

May 31, 2007 (JP) ..... P2007-144677

(51) Int. Cl.
*B04B 15/02* (2006.01)
*B04B 15/06* (2006.01)

(52) U.S. Cl. ..... 494/14; 494/25; 494/26; 494/60

(58) Field of Classification Search ..... 494/7–10, 494/13, 14, 16–21, 23–30, 36, 60, 61; 700/273; 422/72; 210/85, 143, 360.1–380.3
See application file for complete search history.

(56) References Cited

U.S. PATENT DOCUMENTS 2,705,407 A * 4/1955 Colonna ..... 62/532
3,007,629 A * 11/1961 Boyland ..... 494/42
3,108,955 A * 10/1963 Boyland ..... 494/74
3,430,849 A * 3/1969 Nunley et al. ..... 494/12
3,501,091 A * 3/1970 Oyama et al. ..... 494/25
3,613,989 A * 10/1971 Oyama et al. ..... 494/2
4,030,897 A * 6/1977 Pelzer et al. ..... 95/249
4,846,780 A * 7/1989 Galloway et al. ..... 494/3
5,551,940 A * 9/1996 Cote ..... 494/11
6,241,650 B1 * 6/2001 Letourneur ..... 494/11
6,334,841 B1 * 1/2002 Letourneur ..... 494/11
7,144,361 B2 * 12/2006 Aizawa et al. ..... 494/38

(Continued)

FOREIGN PATENT DOCUMENTS

JP 48-28863 9/1973

(Continued)

OTHER PUBLICATIONS

Japanese Office Action, with English translation, issued in Japanese Patent Application No. 2007-144677, mailed Oct. 19, 2010.

*Primary Examiner*—Charles E Cooley
(74) *Attorney, Agent, or Firm*—McDermott Will & Emery LLP

(57) ABSTRACT

According to an aspect of the present invention, there is provided a centrifuge in which a steam sterilization of a sample flow passage is performed, the centrifuge including: a rotor configured to centrifuging a liquid sample; a drive portion that drives and rotates the rotor; a chamber that accommodates the rotor therein, the chamber having a first and a second penetration holes provided on an upper and a bottom portions thereof, respectively; and a first and a second valves disposed on the first and the second penetration holes, respectively; wherein a cooling gas is introduced through one of the first and the second penetration holes and discharged through the other to cool a periphery of the rotor before or after execution of a centrifuging operation of the liquid sample.

9 Claims, 9 Drawing Sheets

U.S. PATENT DOCUMENTS

| | | | | |
|---|---|---|---|---|
| 7,371,205 | B2 * | 5/2008 | Andersson et al. | 494/14 |
| 7,396,324 | B2 * | 7/2008 | Tetsu et al. | 494/7 |
| 7,591,775 | B2 * | 9/2009 | Tobita et al. | 494/14 |
| 7,794,383 | B2 * | 9/2010 | Tetsu et al. | 494/14 |
| 2003/0114289 | A1 * | 6/2003 | Merino et al. | 494/37 |
| 2004/0214711 | A1 * | 10/2004 | Aizawa et al. | 494/79 |
| 2005/0107235 | A1 * | 5/2005 | Tetsu et al. | 494/10 |
| 2006/0009341 | A1 * | 1/2006 | Tobita et al. | 494/14 |
| 2008/0251436 | A1 * | 10/2008 | Tetsu et al. | 210/145 |
| 2008/0300124 | A1 * | 12/2008 | Akatsu et al. | 494/14 |
| 2009/0239729 | A1 * | 9/2009 | Tobita et al. | 494/14 |
| 2010/0075823 | A1 * | 3/2010 | Toi et al. | 494/6 |

FOREIGN PATENT DOCUMENTS

| | | | |
|---|---|---|---|
| JP | 02-002884 | | 1/1990 |
| JP | 7-106328 | | 11/1995 |
| JP | 07-312976 | | 12/1995 |
| JP | 10-099726 | | 4/1998 |
| JP | 2001-321699 | | 11/2001 |
| JP | 2004-322054 | | 11/2004 |
| JP | 2006021121 | A * | 1/2006 |

* cited by examiner

CENTRIFUGE WITH STEAM STERILIZATION

CROSS-REFERENCE TO RELATED APPLICATIONS

This application is based upon and claims a priority from prior Japanese Patent Application No. 2007-144677 filed on May 31, 2007, the entire contents of which are incorporated herein by reference.

BACKGROUND OF THE INVENTION

1. Field of the Invention

An aspect of the present invention relates to a centrifuge which, while charging a liquid sample continuously into a rotor, rotates the rotor at a high speed to centrifuge microparticles contained in the liquid sample.

2. Description of the Related Art

As a centrifuge of this type, there are known a centrifuge which is disclosed in the JP-UM-S48-028863-B for centrifuging a virus contained in a liquid medium, and continuous centrifuges respectively disclosed in the JP-H07-106328-B and JP-2004-322054-A in which a sample to be centrifuged is centrifuged in a state where it is isolated from the open air.

Here, description will be given below of a conventional centrifuge with reference to FIGS. 8 and 9.

FIG. 8 is a perspective view of a conventional centrifuge, and FIG. 9 is a longitudinal section view of a rotation device portion of the centrifuge. The centrifuge shown in these figures is a centrifuge of a type which charges a liquid sample continuously into a rotating rotor 14 and centrifuges the liquid sample. And, this centrifuge is used to centrifuge a virus, a culture cell, a culture fungus body and the like in large quantities to purify mother materials which are used for vaccines and medicines.

FIG. 8 shows a state of a cylindrical rotor 14 in which it hangs down before it is stored into a chamber 10, and in this figure, a rotation device portion 101 includes a lift mechanism 13. Here, the lift mechanism 13 includes a drive portion 12 for mounting and removing the oblong rotor 14. And, the lift mechanism 13 not only can lift, advance and lower an upper plate 17 together with the rotor 14 mounted on the rotation shaft 21 of the drive portion 12 but also, in a state where they are advanced and lowered, can mount and remove the rotor 14.

A control device portion 3 includes a power supply for the drive portion 12 for driving the rotation device portion 101, and a vacuum pump for depressurizing the chamber 10. The control device portion 3 supplies cooling water or the like for cooling mechanical seals 24 and 25 (see FIG. 9) respectively serving as a charge/discharge portion for charging and discharging the cooling water of the lower bearing portion 23 as well as refrigerants and samples which flow in a cooling coil for cooling the rotor 14. Also, the control device portion 3 incorporates therein a controller (not shown) for controlling a power supply and an electric signal necessary for driving it, and further includes a control panel 31. The control panel 31 not only can set the speed of revolutions, the time of rotation, temperature and the like functioning as the operating conditions of the present centrifuge, and can display the operating state of the centrifuge, but also includes a switch which can be used to start and stop the operation of the centrifuge. Further, although not shown, the control device portion 3 includes therein a hydraulic unit which includes a refrigerator for cooling cooling water, a refrigerator for cooling refrigerants used to cool the rotor 14, a hydraulic pump for driving the lift mechanism 13, a control valve and the like.

Also, a pipe/electric wire connecting portion 4 is a connecting portion which is used to control the connection of the electrical parts, the supply of the cooling water and refrigerants, the depressurization operation and the like in order to operate the rotation device portion 101 from the control device portion 3.

FIG. 9 shows a longitudinal section view of the main portion of the rotation device portion 101 of the centrifuge, in which the cylindrical rotor 14 disposed in the vertical direction of the centrifuge is supported by two hollow upper and lower rotation shafts 21 and 22 respectively extended in the axial direction of the rotor 14, while the interior of the rotor 14 and the hollow portions of the rotation shafts 21, 22 cooperate together in forming a continuous liquid flow passage.

Also, in the interior of the rotor 14, there is disposed an exchangeable core 28 including a plurality of circumferentially equally divided blade-shaped partition walls respectively provided on and projected from the outer peripheral portion thereof, while this core 28 forms a flow passage for a sample. The upper rotation shaft 21 is connected to the drive portion 12; and, to the upper rotation shaft 21, there can be transmitted a drive force for driving and rotating the rotor 14. The lower rotation shaft 22 is rotatably supported not only by a sliding bearing (plain bearing) which is used to center the rotor 14 and dampen the rotational vibrations thereof but also by a lower bearing portion 23 which is provided on the outer peripheral portion of the lower rotation shaft 22 and includes a damper. By the way, the upper and lower bearings are lubricated with lubricant and, while the rotor 14 is rotating, a very small amount of lubricant leaks out to the chamber 10 side and collects in the bottom portion of the chamber 10. In order to collect this waste lubricant after stop of the operation of the rotor 14, there is formed a small hole in the bottom of the chamber 10 and, on the open end of the small hole, there is provided a drain valve 30.

Further, on the end portions of the upper and lower rotation shafts 21, 22, there are provided the mechanical seals 24 and 25 respectively. Thus, even while the rotor 14 and rotation shafts 21, 22 are rotating at high speeds, the liquid samples are allowed to flow through these mechanical seals 24 and 25 and, in order to cool the mechanical seals 24 and 25, there flows a coolant around the mechanical seals 24 and 25. Each of the mechanical seals 24 and 25 includes a rotation shaft side member, a non-rotating fixed seal, a spring for bringing the fixed seal into contact with its associated rotation shaft 21 (22), and the like. This structure makes it possible for the liquid sample to flow even while the rotation shafts 21 and 22 are rotating at high speeds.

On the periphery of the rotor 14, there is wound a cooling coil 15 which is used to cool the rotor 14; on the outside of the cooling coil 15, there is disposed a defense wall (protector) 16; and, the chamber 10 is disposed in such a manner that it surrounds these members. The chamber 10 cooperates with a base 11 disposed downwardly of the chamber 10 and an upper plate 17 (which also serves as the support member of the drive portion 12) in constituting a vacuum chamber. The chamber 10 can be depressurized from the pipe connecting port that is formed in the barrel portion of the chamber 10, while the rotor 14 can be driven and rotated within the depressurized chamber 10.

In the above-structured centrifuge, the liquid sample to be centrifuged is supplied from the connector portion 26 (or 27) of the rotation device portion 101 by delivery means such as a pump (not shown), is introduced through the rotation shaft 21 (or 22) into the rotor 14, and is centrifuged within the rotor 14 due to a strong centrifugal force applied thereto; and, the supernatant of the liquid sample is discharged therefrom through the other rotation shaft 22 (or 21), mechanical seal 25 (or 24) and connector portion 27 (or 26). And, the discharged liquid sample after centrifuged is collected into a storage vessel (not shown) or the like.

The sample to be treated in the thus structured centrifuge includes, for example, an influenza virus, a Japanese encephalitis virus, a whooping cough virus, an AIDS virus, a hepatitis virus and the like. The parent material of such sample is obtained by floating, on a liquid, a culture medium, a cell or a body fluid taken from an animal, and the like. The sample is centrifuged and rectified using the present centrifuge and is used as the material of a vaccine and a medicine. Careful attention must be paid to such sample in order to prevent other viruses or impurities from mixing with such sample to contaminate it. In the medical manufacturing field and in the medical field, as means for sterilizing bacteria and various kinds of minor germs adherent to medicine manufacturing machine and instrument, there is often used steam sterilization (which is also referred to as autoclaving).

However, in the centrifuge, such steam sterilization is not enforced owing to the structural limit thereof and owing to the limit of the material of the parts thereof, but there is employed exclusively a method for sterilizing the centrifuge using a bath. The bath sterilization is not sufficient, because some of baths have no effect on some of bacteria and various kinds of minor germs. Also, when such bacteria and minor germs come into contact with the composing parts of the centrifuge, it has been found that they can corrode or degenerate the composing parts.

On the other hand, the steam sterilization has a wide effective range and has a sterilization effect on most of bacteria and various minor germs, and also the sterilization effect can be obtained by heating using steam. Therefore, when the composing parts of the centrifuge have heat resisting properties, the steam sterilization can be applied. Recently, as disclosed in the JP-2004-322054-A, it has been able to apply the steam sterilization also to a continuous centrifuge structured such that a steam sterilizable metal-made core is inserted into a rotor provided in the centrifuge.

Also, in the JP-2001-321699-A, there is proposed a technology which, in a centrifuge capable of treating an inflammable sample, measures the oxygen density of the interior of a rotor filled with an inert gas and, when the measured oxygen density exceeds a given value, stops the drive device of the centrifuge.

When steam sterilization is enforced on a centrifuge with a cylindrical rotor mounted thereon, the steam sterilization temperature is set at lowest at a temperature of 115° C., in most cases, at a temperature of 121° C. at which a higher effect can be obtained. Thus, it takes long time to cool the cylindrical rotor from such high temperatures down to the temperature range of 4° C.~room temperature which are the temperatures necessary for the centrifugal separation, resulting in the very poor centrifuging operation efficiency.

As a solution to the above problem, there is known a method in which a liquid of a low temperature is charged into a cylindrical rotor to cool the rotor. In this method, however, when the charged liquid boils or evaporates at a high temperature, in some cases, there is generated an inconvenience that impurities contained in the liquid or the compositions of the liquid stick to the surface of the rotor and the surfaces of the sample flow passage composing parts of the centrifuge and provide the contamination source of the sample when the sample is used later.

SUMMARY OF THE INVENTION

The present invention aims at solving the above problem. Thus, it is an object of the invention to provide a centrifuge which can cool quickly the composing parts of the sample flow passage including a rotor from their high temperature states to thereby be able to enhance the efficiency of the centrifuging operation thereof.

According to an aspect of the present invention, there is provided a centrifuge in which a steam sterilization of a sample flow passage that is provided for flowing a liquid sample therethrough is performed, the centrifuge including: a rotor that is configured to centrifuging the liquid sample; a drive portion that drives and rotates the rotor; a chamber that accommodates the rotor therein, the chamber having a first penetration hole provided on an upper portion thereof and a second penetration hole provided on a bottom portion thereof; a first valve that is disposed on the first penetration hole; and a second valve that is disposed on the second penetration hole; wherein a cooling gas is introduced through one of the first and the second penetration holes and discharged through the other to cool a periphery of the rotor before or after execution of a centrifuging operation of the liquid sample.

According to such a configuration, a gas for cooling is introduced into the chamber from one of the two penetration holes respectively formed in the upper and bottom portions of the chamber to discharge the gas existing within the chamber externally of the chamber from the other penetration hole, thereby cooling the periphery of the rotor within the chamber with the gas. Owing to this, the composing parts of the sample flow passage including the rotor can be cooled quickly from their high temperature states, which can enhance the efficiency of the centrifugal operation of the centrifuge.

A cooling gas or a cooling liquid may be introduced into the rotor through the sample flow passage.

According to such a configuration, since a gas or a liquid for cooling is charged from the sample flow passage into the rotor as well, the rotor the temperature of which has become high due to the steam sterilization can be cooled effectively both from inside and from outside, whereby the composing parts of the sample flow passage including the rotor can be cooled further quickly to thereby be able to enhance the efficiency of the centrifugal operation.

As viewed in a rotation axis direction of the rotor, the first and the second penetration holes may be separated by an angle in a range of from 90 degree to 270 degree in an angle axis direction of the rotor.

According to such a configuration, since the two penetration holes are disposed at positions spaced from each other by an angle of 90 degrees~270 degrees with the rotation axis of the rotor as a center thereof, the gas flowing through the chamber is allowed to flow in such a manner as to surround the outer surface of the rotor to thereby exchange its heat with the heat of the surface of the rotor and the like. This can enhance the cooling efficiency of the composing parts of the sample flow passage including the rotor, thereby being able to cool these composing parts further quickly.

The centrifuge may further include: a filter disposed on one of the first and the second valves from which the cooling gas is discharged.

According to such a configuration, the filter is disposed on the open end of the opening/closing valve disposed on the side where the gas for cooling is discharged. Here, when the inside of the chamber is forcibly cooled by a gas, the sample is convected to generate dangerous convection substance. However, according to the invention, such dangerous convection substance can be trapped by the filter positively. This can prevent such convection substance from doing harm to the operator of the centrifuge as well as to persons concerned, thereby being able to secure a high degree of safety. Also, when the centrifuge is installed in a clean room or in a biohazard room, it is possible to avoid a trouble that the filter in such room can be clogged with the convection substance.

The centrifuge may further includes: a pipe, one end of which being connected to one of the first and the second valves to introduce the cooling gas thereinto, the pipe being extended so that the other end of which is disposed outside a room in which the centrifuge is installed.

According to such a configuration, since a pipe is connected to the open end of the opening/closing valve disposed on the cooling gas discharge side and the open end of the pipe is opened to the outside of the room, not only the room, in which the centrifugal separator is installed, can be prevented against contamination or danger, but also there can be reduced the noises that are generated when the gas is discharged.

At least one of the first and the second valves may include a power valve. A controller that controls the power valve may be provided.

According to such a configuration, since at least one of the two opening/closing valves is formed as a power valve, and there is provided control means for controlling the power valve, a desired one of the opening/closing valves can be opened and closed easily using a valve switch or the like. Also, an operation in linking with the control portion of the centrifuge can also be realized easily and simply.

BRIEF DESCRIPTION OF THE DRAWINGS

Embodiments of the present invention will be described in detail based on the following figures, wherein.

DETAILED DESCRIPTION OF THE INVENTION

Description will be given below of embodiments according to the invention with reference to the accompanying drawings.

Embodiment 1

Figure 1:
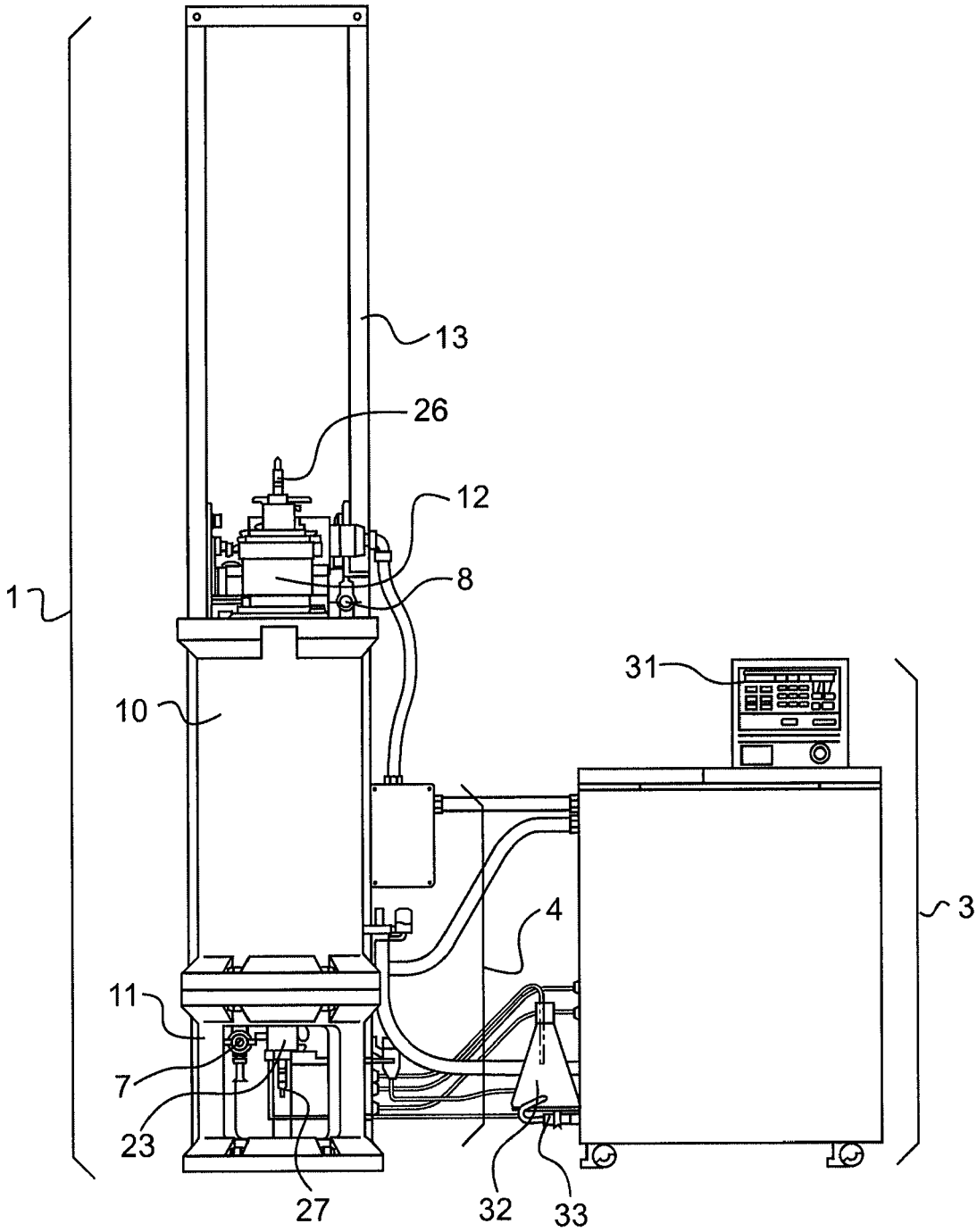
FIG. 1 is a front view of a centrifuge according to an embodiment 1.

FIG. 1 is a front view of a centrifuge according to an embodiment 1. In FIG. 1, the rotation device portion 1 of the present centrifuge is fixed to a floor using a bolt, and, on the right of the rotation device portion 1, there is installed a control device portion 3 with a given distance therefrom, while the rotation device portion 1 and control device portion 3 are connected to each other by various connecting pipes/electrical wires 4.

The control device portion 3 includes a control panel 31 provided on the upper portion thereof. The control panel 31 has a function for setting the speed of revolutions, rotation time, temperature and the like which are the operating conditions of the present centrifuge, a function for displaying the operating state of the centrifuge, a start/stop switch used to operate the centrifuge, and other functions. Also, the control device portion 3 further includes in the inside thereof: a power source (for example, an inverter) for a drive portion 12 used to operate the rotation device portion 1; two tanks respectively used to supply cooling water for cooling the drive portion 12 and the lower bearing portion 23; a cooling coil; a first refrigerator; a second refrigerator for sending out a refrigerant which is allowed to flow through the cooling coil for cooling a cylindrical rotor 14; a control valve used to control cooling water for cooling mechanical seals 24 and 25 which serve as a sample charge/discharge portion; a vacuum pump for depressurizing the inside of a chamber 10; and, a controller used to control not only the inverter for drive portion 12 but also a power source and an electrical signal necessary for operation of the centrifuge.

Also, the control device portion 3 further includes: a hydraulic unit for supplying and controlling high pressure oil used to operate a lift mechanism 13; a cooling device for cooling the drive portion 12; a tank 32 for storing cooling water used to cool the mechanical seals provided in the inside of the lower bearing portion 23; and, a pipe 33 for allowing the mechanical seal cooling water to flow therethrough.

Next, description will be given below of the details of the structure of the rotation device portion 1 with reference to FIG. 2.

Figure 2:
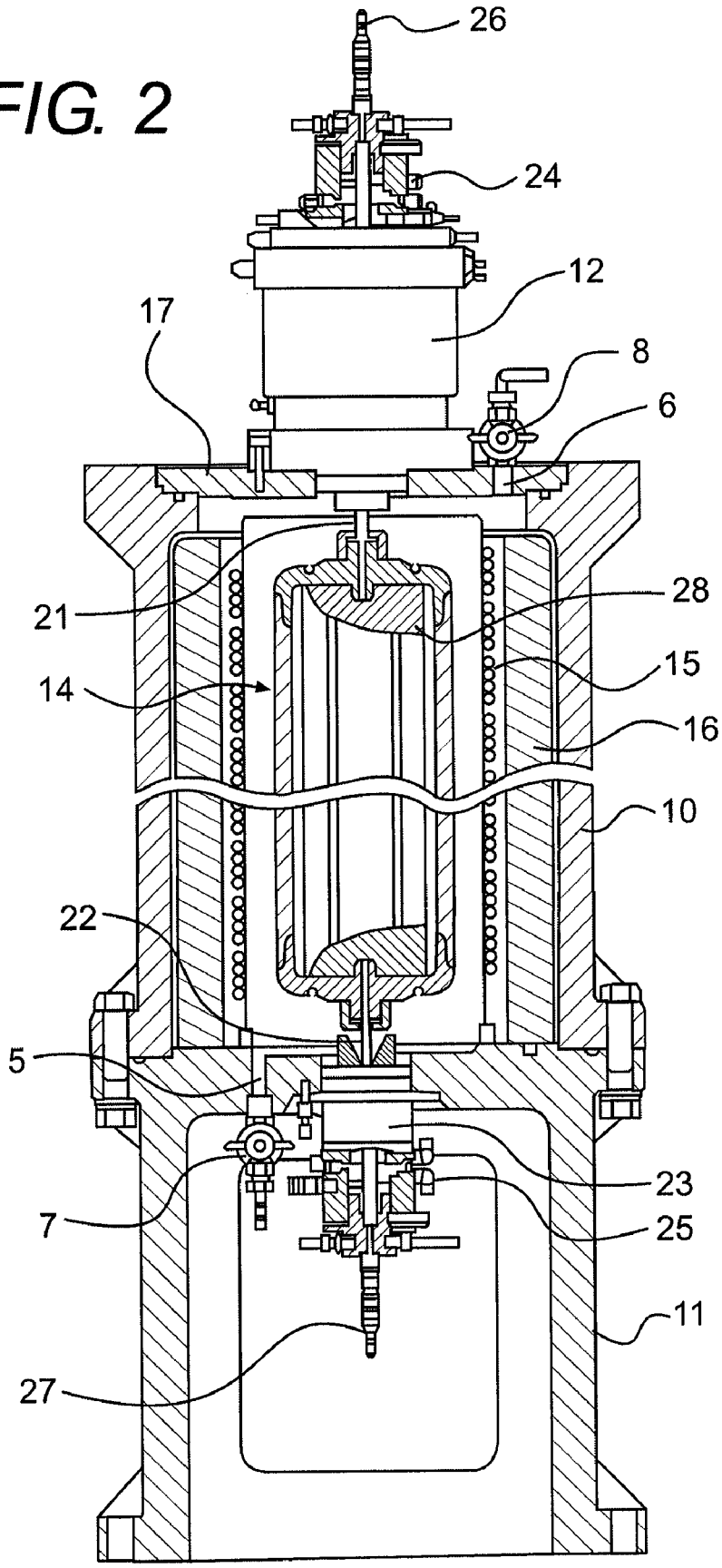
FIG. 2 is a front section view of a rotation device portion of a centrifuge according to an embodiment 1.

FIG. 2 is a front section view of the rotation device portion 1. As shown in FIG. 2, below the chamber 10, there is disposed a bottom valve 7 connected to a bottom penetration hole 5 in communication with the inside of the chamber 10; and, above the chamber 10, there is disposed an upper penetration hole 6 which communicates with the inside of the chamber 10. Also, the rotation device portion 1 is structured such that the lift mechanism 13 for mounting and removing the rotor 14 can be operated to remove the rotor 14 portion upwardly from the chamber 10 and the rotor 14 portion can be then moved forwardly and downwardly to thereby be able to mount and remove the rotor 14.

The chamber 10 is fixed by a bolt to the top surface of a base 11 which is fixed to a floor by a bolt, on the upper surface opening portion of the chamber 10, there is mounted an upper plate 17 serving as a cover, and, on the upper plate 17, there is disposed the drive portion 12.

The cylindrical rotor 14 disposed in the vertical direction is rotatably supported by two upper and lower rotation shafts 21 and 22 extended respectively from the drive portion 12 and lower bearing portion 23 in the axial direction thereof, and a continuous sample flow passage is formed by a passage which connects together the inside of the rotor 14 and the hollow portions of the rotation shafts 21, 22. And, in the inside of the rotor 14, there is disposed a replaceable core 28 including a plurality of blade-shaped partition walls which are respectively provided on the outer peripheral portion of the core 28 and equally divide the outer peripheral portion of the core 28 into a plurality of portions in the circumferential direction of the core 28; and, this core 28 forms the sample flow passage.

Here, the rotor 14 is a hollow member which is normally made of a titanium alloy in order to be able to withstand high speed rotation such as rotation of 40,000 rpm. The rotor 14 has an outside diameter of 160 mm and a length of approx. 800 mm, while the mass of the rotor 14 is about 25 kg. Also, the core 28, which is inserted into the rotor 14, is used in order to guide the sample up to a position which exists in the inside diameter wall side direction of the rotor 14 and provides a high centrifugal acceleration. The core 28, similarly to the rotor 14, requires high strength and, in order to withstand steam sterilization, is made of metal such as a titanium alloy which is highly resistant to heat.

The upper rotation shaft 21 is connected to the drive portion 12 and, to the upper rotation shaft 21, there is transmitted the drive force that drives and rotates the rotor 14. The lower rotation shaft 22, in order to center the rotor 14 and dampen the rotation vibrations of the rotor 14, is rotatably supported by the lower bearing portion 23 which includes a slide bearing (plain bearing) and a damper provided on the outer peripheral portion of the slide bearing (plain bearing). And, on the end portions of the upper and lower rotation shafts 21 and 22, there are provided the mechanical seals 24 and 25 respectively. Owing to this structure, the liquid sample is allowed to flow through these parts even while the rotor 14 and rotation shafts 21, 22 are rotating at a high speed; and, cooling water is allowed to flow around the mechanical seals 24 and 25 for cooling the same.

Here, the mechanical seals 24 and 25 are each made of rotation shaft side members, non-rotating fixed seals and springs which are respectively used to bring their associated fixed seals into contact with the rotation shafts 21 and 22. That is, these mechanical seals 24 and 25 are structured such that the liquid sample is allowed to flow therethrough even while the rotation shafts 21 and 22 are rotating at a high speed.

On the periphery of the rotor 14, there is wound a cooling coil 15 which is used to cool the rotor 14, and on the outside of the cooling coil 15, there is provided a defense wall (protector) 16, while the chamber 10 is disposed so as to surround these parts. While cooperating together with the base 11 disposed downwardly of the chamber 10 and the upper plate 17 serving also as the support member of the drive portion 12, the chamber 10 constitutes a vacuum chamber. The chamber 10 can be depressurized from the pipe connecting opening that is formed in the barrel portion of the chamber 10, while the rotor 14 is driven and rotated within the chamber 10 that is held vacuum.

Also, in the base 11 that constitutes the bottom portion of the chamber 10, there is formed a bottom penetration hole 5 which communicates with the inside of the chamber 10; and, to the lower open end of the bottom penetration hole 5, there is connected the bottom valve 7. Similarly, in the upper plate 17 which is provided upwardly of the chamber 10, there is formed an upper penetration hole 6 which communicates with the inside of the chamber 10; and, to the upper open end of the upper penetration hole 6, there is connected the upper valve 8.

Steam sterilization to be carried out by the thus structured rotation device portion 1 aims at sterilizing the sample flow passage before the start of a centrifuging operation, or after the centrifugal separation of the dangerous constituents of the sample. Specifically, in a state shown in FIG. 2, steam is introduced from an upper sample connector portion 26 and is discharged from a lower sample connector portion 27. In this case, just before the steam is introduced, it is controlled for the pressure and condensed water thereof, and thus the sample flow passage including the rotor 14 is steam sterilized while it is held at a given temperature (for example, a temperature of 121° C.) for a given period of time (for example, for 20 minutes). After the elapse of the given time of the steam sterilization, the supply of the steam is stopped. However, the rotor 14 and core 28 respectively made of a titanium alloy are large in heat capacity and it takes a long time, that is, about 5~8 hours to let them cool naturally down to the normal temperature thereof, which results in the very poor operation efficiency.

In view of the above, according to the present embodiment, a gas charge pipe (not shown) is connected to the bottom valve 7 provided on the base 11, the bottom valve 7 is opened to introduce, for example, compressed air from the gas charge pipe into the chamber 10, and the upper valve 8 provided on the upper plate 17 is opened to discharge the compressed air externally of the chamber 10, whereby, while flowing through the outer peripheral portion of the rotor 14, the compressed air deprives the rotor 14 of heat to thereby forcibly cool the rotor 14. At the same time, the compressed air is introduced from the upper sample connector portion 26 into the sample flow passage and the compressed air is discharged from the lower sample connector portion 27, thereby cooling the core 28 and the inner surface of the rotor 14 forcibly. In this embodiment, according to the results of a test conducted under the condition that the actual pressure of the compressed air was set for 0.5 Mpa, the time taken to cool the rotor 14 and core 28 from the temperature of 121° C. to the temperature of 20° C. was approx. 1.5 hrs. Thus, when compared with a case where they are allowed to cool down naturally, the cooling time could be reduced greatly, specifically, down to ⅕~¼. Also, when they are cooled down to, for example, a temperature of 60° C. according to the forced cooling method and, after then, in combination with this, there is used the cooling method in which the liquid is introduced into the sample flow passage, a total of the cooling time from 121° C. to 20° C. could be shortened down to approx. 45 minutes. That is, this combined method could shorten the cooling time to such value that provides no practical problem at all.

Figure 3:
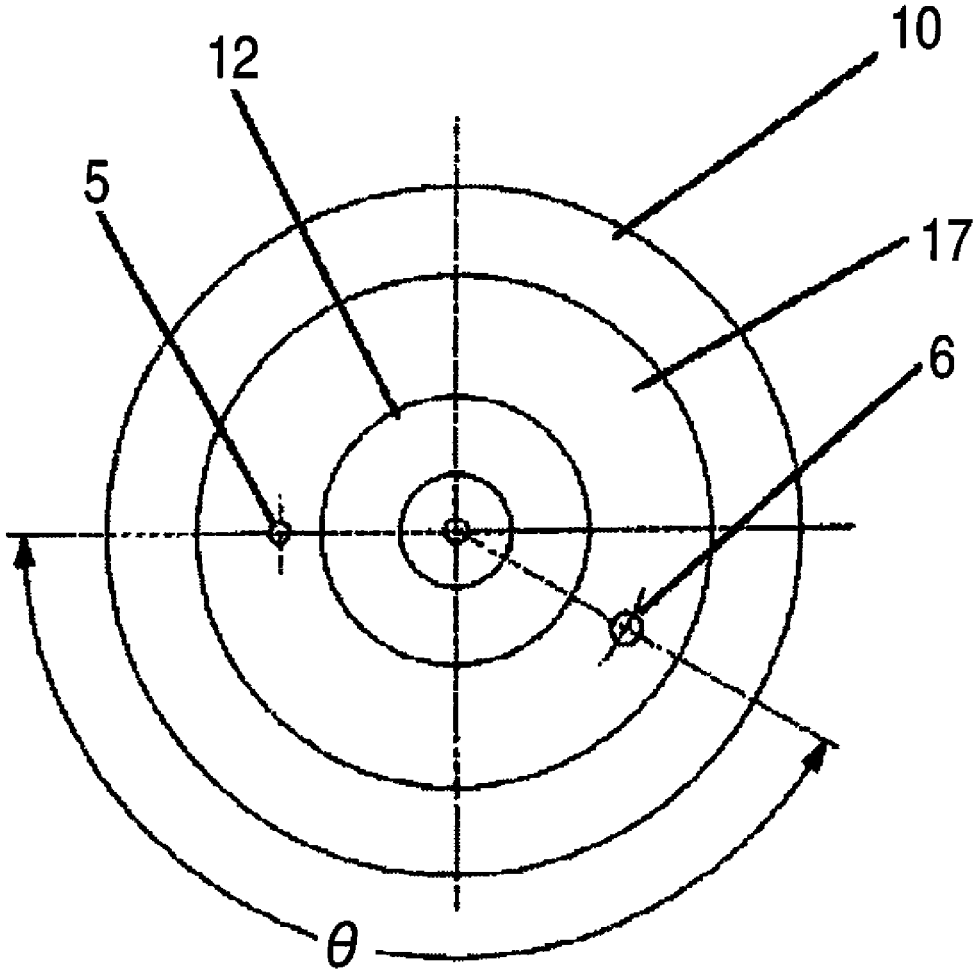
FIG. 3 is a top plan view of a chamber portion of a centrifuge according to an embodiment 1.
Figure 4:
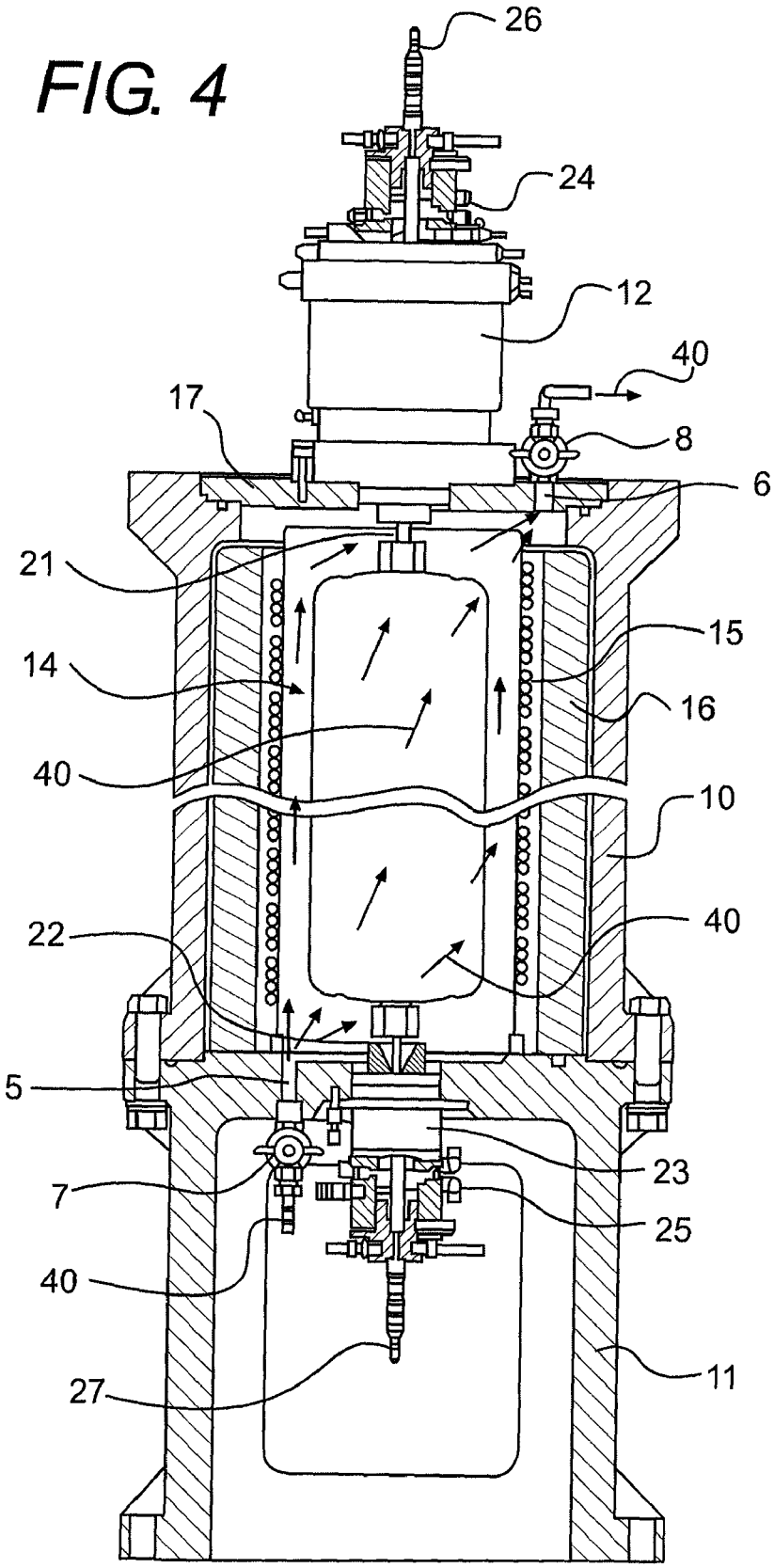
FIG. 4 is a front section view of a rotation device portion of a centrifuge according to an embodiment 1, showing the flow of compressed air.

Now, FIGS. 3 and 4 respectively show the rotation device portion 1 according to the present embodiment. Specifically, FIG. 3 is a top plan view of the chamber 10 portion of the rotation device portion 1, showing the position relationship between the bottom penetration hole 5 in communication with the inside of the chamber 10 and the upper penetration hole 6 formed in the upper plate 17. When the two penetration holes 5 and 6 are disposed such that they are spaced from each other by an angle θ in the peripheral direction of the rotor 14, the efficiency of the forced cooling of the rotor 14 and the like can be enhanced. Here, it is proper that the angle θ is set in the range of 90°~270°. The reason for this will be described below with reference to FIG. 4.

Specifically, FIG. 4 is a front section view of the rotation device portion 1. When the bottom penetration hole 5 and upper penetration hole 6 are, as shown in FIG. 3, disposed spaced from each other by the angle θ (90°~270°) in the peripheral direction of the rotor 14 with the rotation shaft of the rotor 14 as a center thereof, the compressed air introduced into the chamber 10 from the bottom penetration hole 5 through the bottom valve 7, as shown by the arrow marks 40 shown in FIG. 4, flows in such a manner as to surround the outer surface of the rotor 14, whereby the compressed air exchanges its heat with the heat of the surface of the rotor 14 and thus can cool the rotor 14 with high efficiency. Here, when the disposition angle θ of the two penetration holes 5 and 6 in the peripheral direction of the rotor 14 is less than 90°, most of the compressed air flows with a given width. For example, the flow of the compressed air on the 180° side (on the back side of the rotor 14) is small and, therefore, the heat exchange between the compressed air and rotor 14 cannot be promoted. This seems to worsen the cooling efficiency of the rotor 14.

Here, according to the present embodiment, the compressed air is introduced from the bottom portion of the inside of the chamber 10, the compressed air is discharged from the upper portion of the chamber 10, and the compressed air from the upper sample connector portion 26 is allowed to flow from the upper portion to the lower portion within the rotor 14. However, the compressed air may also be allowed to flow reversely. Also, according to the present embodiment, the compressed air is used as the cooling air. However, instead of the compressed air, there may also be used an inert gas such as a nitrogen gas.

Also, in the stage when the compressed air is changed into the chamber 10 and rotor 14 and the temperature of the rotor 14 is thereby lowered a certain degree, distilled water may be charged into the rotor 14 to cool the rotor 14. Or, while charging the compressed air into the chamber 10, distilled water may be charged into the rotor 14 simultaneously. Further, at the stage when the compressed air is charged into the chamber 10 and the temperature of the rotor 14 is thereby lowered a certain degree, distilled water may be charged into the rotor 14.

Figure 5:
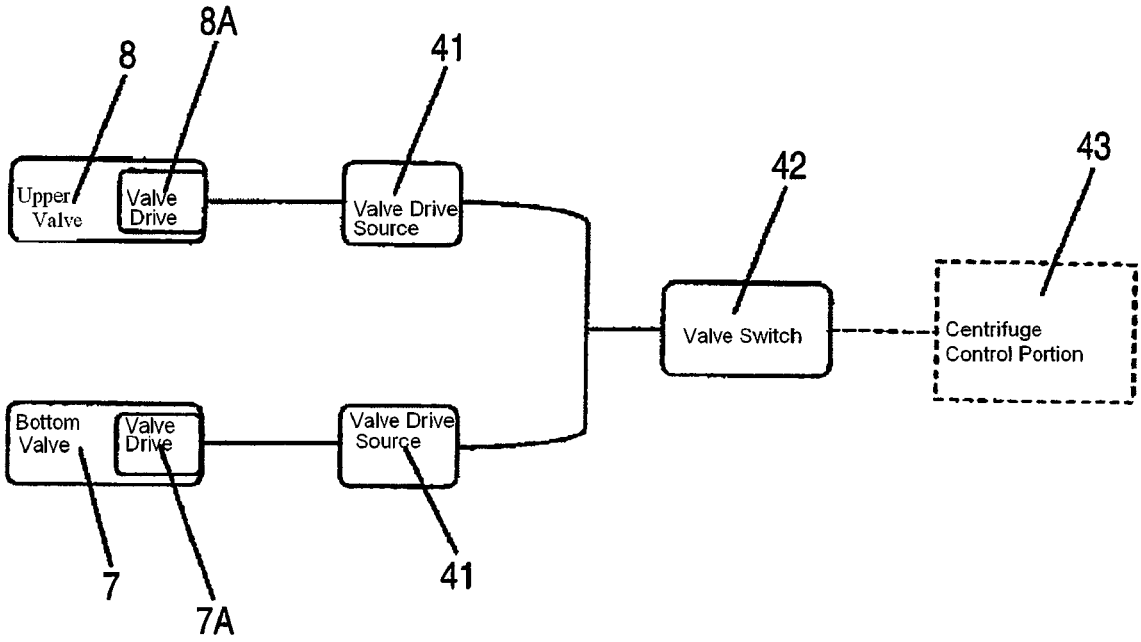
FIG. 5 is a block diagram of an example of a drive control system for the bottom and upper valve portions of a centrifuge according to an embodiment 1.

By the way, the bottom valve 7 and upper valve 8, as shown in FIG. 5, may also be made of power valves respectively including valve drive portions 7A and 8A which can be operated on electricity or air pressure; and, the bottom valve 7 and upper valve 8 may be opened and closed by valve drive sources 41 which can be respectively driven by a valve switch 42. Or, the valve switch 42 may be operated by a centrifuge control portion 43, whereby the bottom valve 7 and upper valve 8 may be opened and closed automatically. In the illustrated embodiment, both of the bottom valve 7 and upper valve 8 are made of power valves. However, only one of them may also be made of a power valve.

Embodiment 2

Next, description will be given below of an embodiment 2 according to the invention with reference to FIG. 6.

Figure 6:
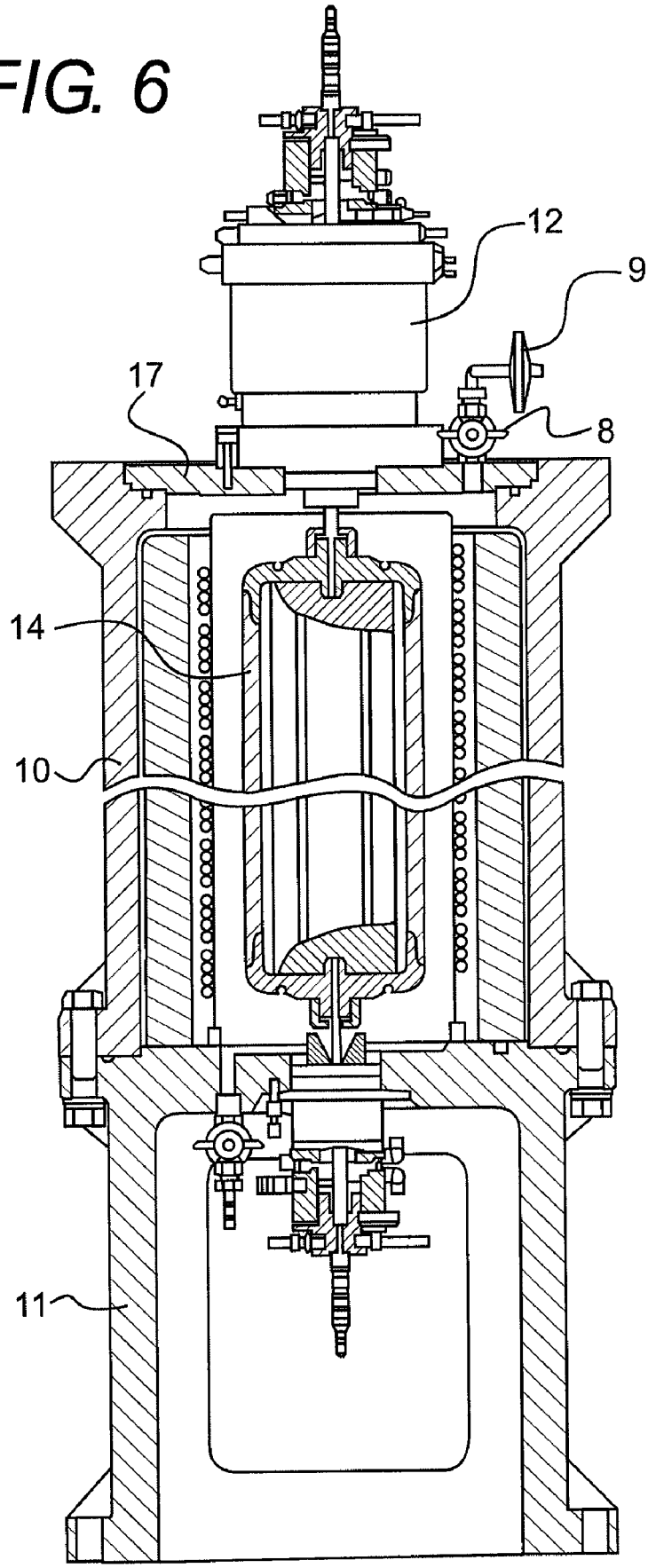
FIG. 6 is a front section view of a rotation device portion of a centrifuge according to an embodiment 2.

FIG. 6 is a front section view of a rotation device portion of a centrifuge according to an embodiment 2. In FIG. 6, the same elements as those shown in FIGS. 1~4 are given the same designations and thus duplicate description thereof will be omitted below.

A centrifuge according to the present embodiment is characterized by an air filter 9 which is provided on the open end of the upper valve 8 disposed on the upper plate 17 mounted on the upper portion of the chamber 10, while the structures of the remaining portions of the present embodiment are similar to those of the previously described embodiment 1.

The sample to be treated in a continuous centrifuge, as described above, is produced from a living thing such as a virus, a bacterium or the like, and thus there is a possibility that the sample can be dangerous to the operator of the centrifuge and persons concerned. Specifically, there is a possibility that, while this type of sample is being treated in a centrifuge, it can leak from the rotor 14 and can be then charged into the chamber 10. In this case, there is a possibility that, when the inside of the chamber 10 is forcibly cooled by a gas such as a compressed air, the sample can be convected within the chamber 10, resulting in the dangerous sample. When such convected dangerous sample is discharged to the air from the open end of the upper valve 8 provided on the upper plate 17, there is raised a possibility that the dangerous sample can cause an unfavorable situation for the operator of the centrifuge and persons concerned.

In view of the above, according to the present embodiment, there is provided an air filter 9 on the open end of the upper valve 8 disposed on the upper plate 17. Therefore, the dangerous material of the sample, which is produced when the sample is convected within the chamber 10, can be positively trapped by the air filter 9, thereby being able to secure high level of safety.

By the way, when a centrifuge is installed and used in a clean room or a biohazard safety room, a gas for forced cooling is discharged into such room. However, it is not favorable that dust or a foreign matter existing within the chamber 10 is discharged out together with the gas from the open end of the upper valve 8. The reason for this is as follows. That is, such room is structured such that it limits the flow-in and flow-out of the gas; and also, in the boundary portion of such room, there is provided a filter such as a HEPA filter, which, however, gives rise to the clogged state of the filter in such room.

Here, the mesh of the air filter 9 must have such a fine size that can trap the dangerous material and, generally, to trap a virus or a bacterium, there is used an air filter having a mesh of 1~2 μm.

Embodiment 3

Next, description will be given below of an embodiment 3 according to the invention with reference to FIG. 7.

Figure 7:
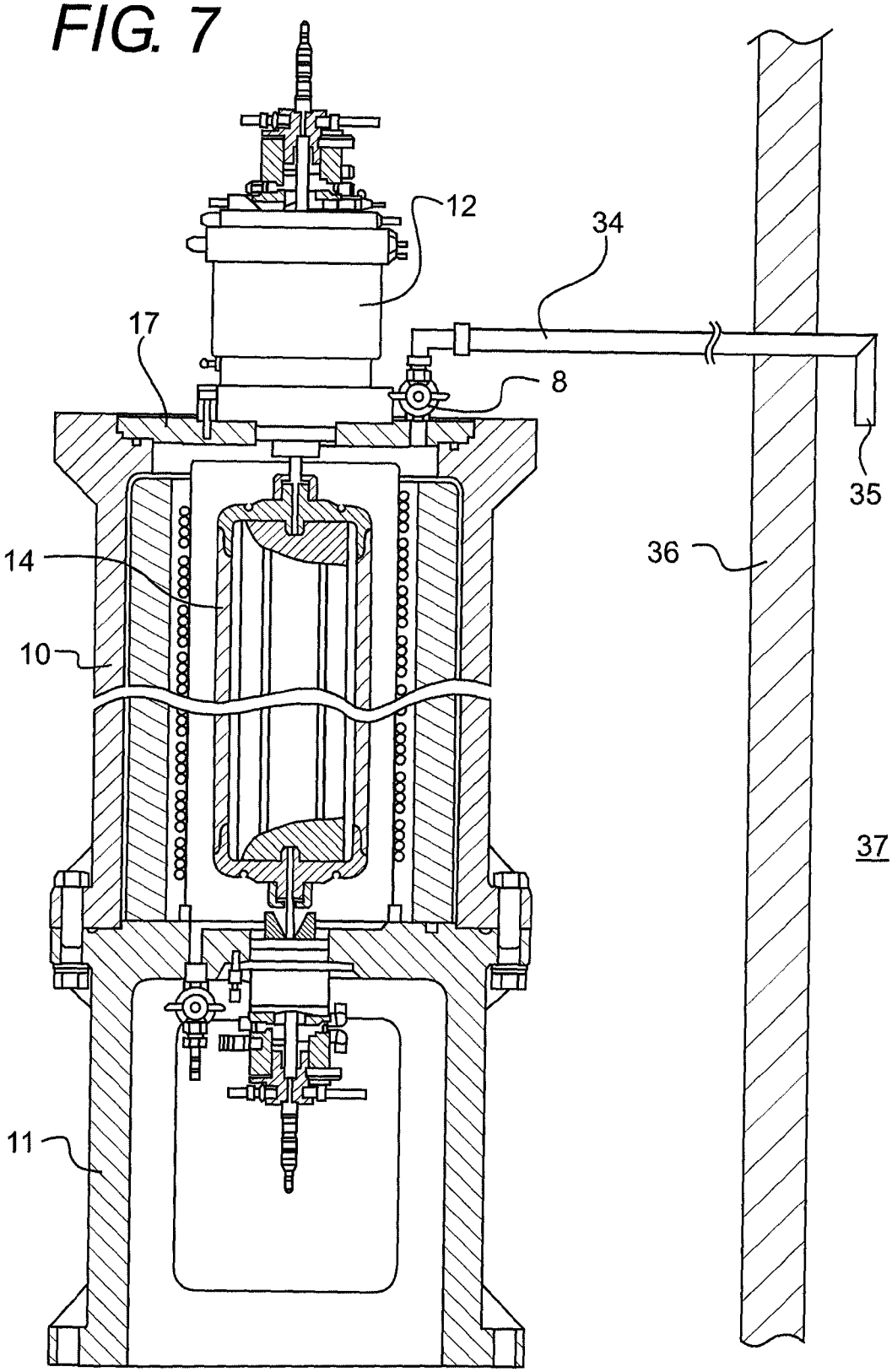
FIG. 7 is a front section view of a rotation device portion of a centrifuge according to an embodiment 3.
Figure 8:
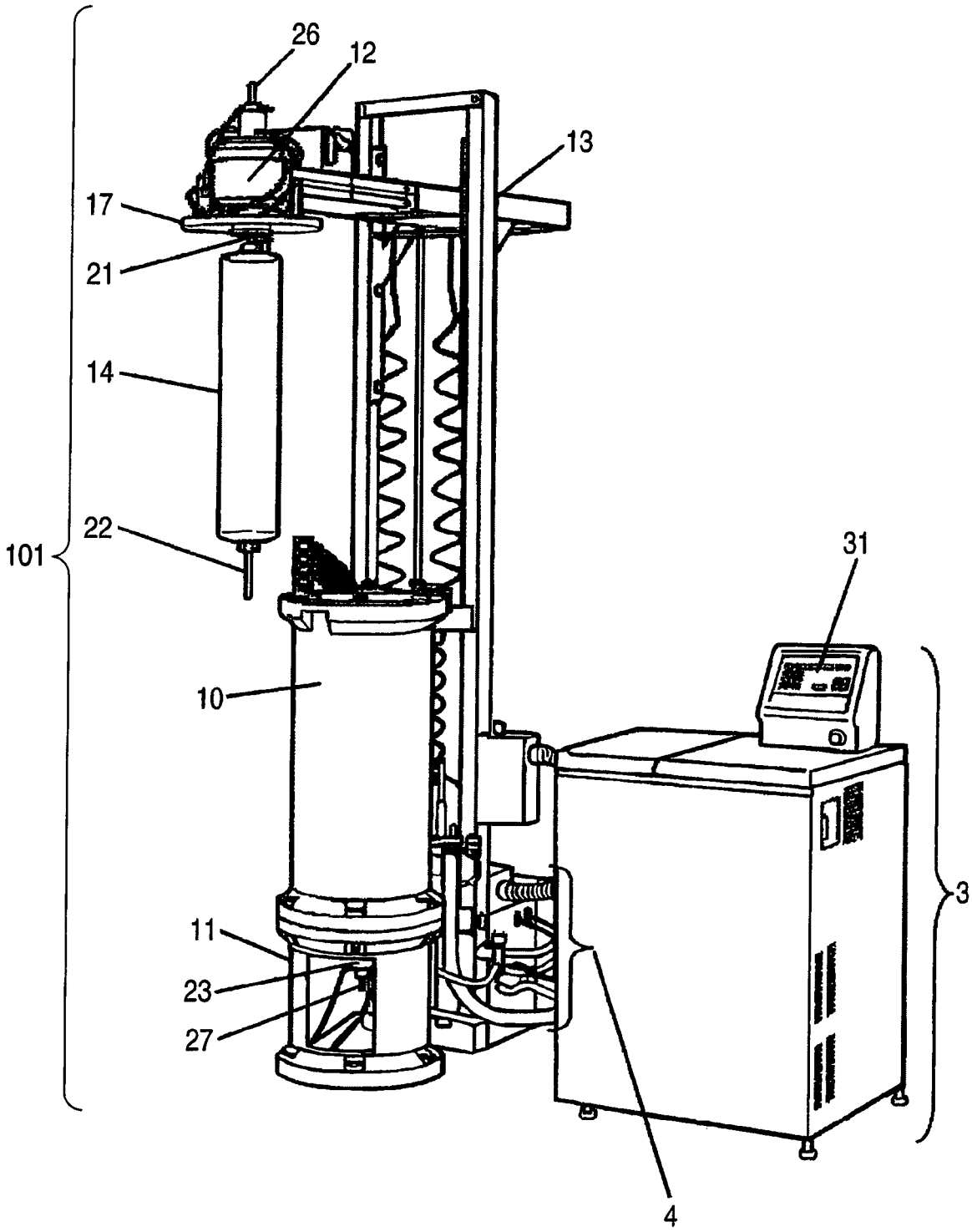
FIG. 8 PRIOR ART
FIG. 8 is a perspective view of a conventional centrifuge.
Figure 9:
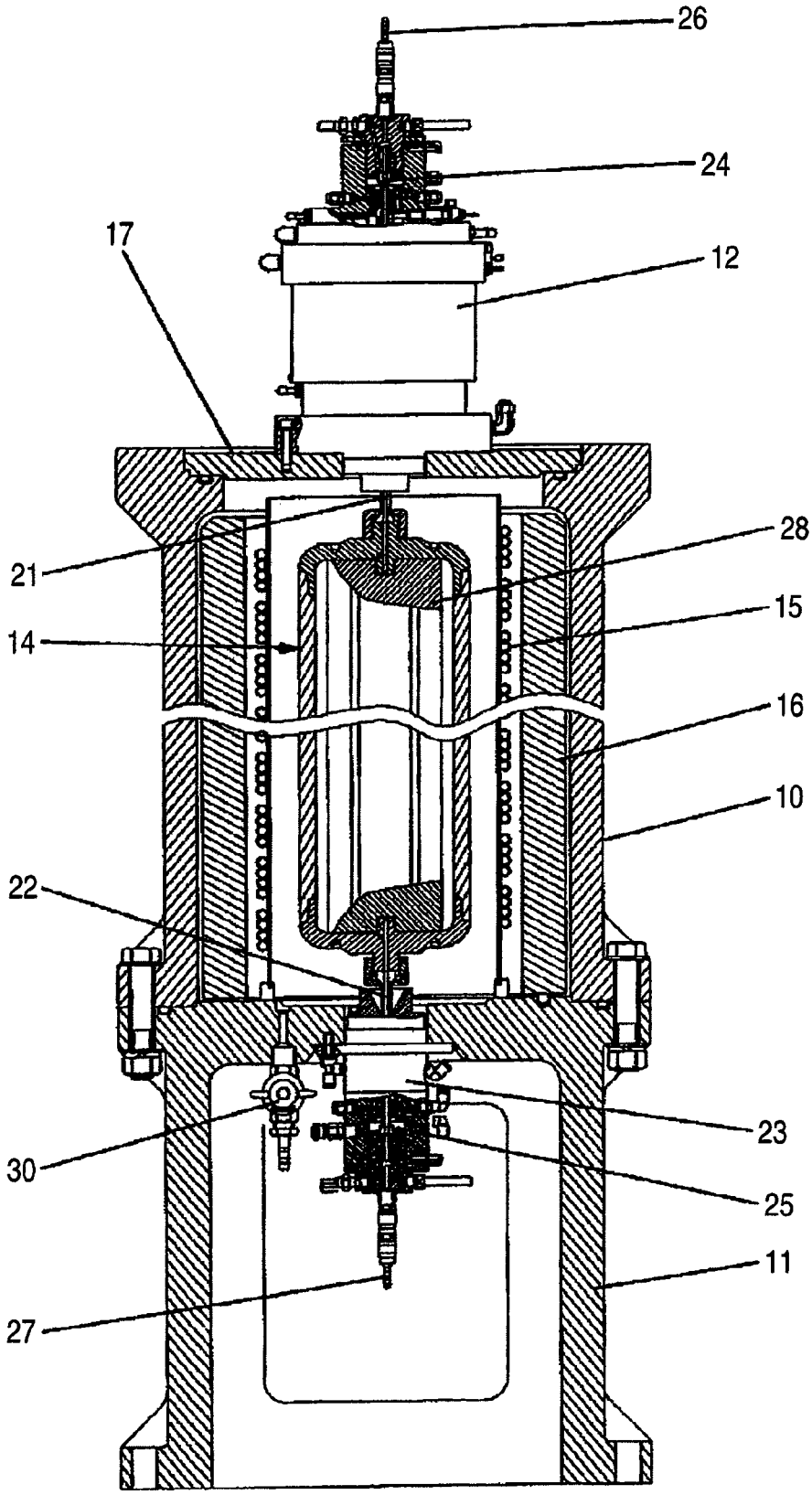
FIG. 9 PRIOR ART
FIG. 9 is a longitudinal section view of a rotation device portion of the conventional centrifuge.

FIG. 7 is a front section view of a rotation device portion included in a centrifuge according to an embodiment 3, in which the same elements as those shown FIG. 6 are given the same designations and thus the duplicate description thereof will be omitted here.

According to the present embodiment, a pipe 34 is connected to the upper valve 8 provided on the upper plate 17 disposed upwardly of the chamber 10, the pipe 34 is penetrated through a partition wall 36 and is extended externally of the outside 37 of a centrifuge installation room, and the open end 35 of the pipe 34 is opened to the room outside 37, whereby a gas for cooling introduced into the chamber 10 is discharged from the pipe 34 to the room outside 37. The structures of the remaining portions of the present embodiment are the same as those employed in the previously described embodiments 1 and 2.

Thus, according to the present embodiment, not only the room, in which the centrifuge is installed, can be prevented against contamination and danger, but also it is possible to reduce the noise that is generated when the gas is discharged.

What is claimed is:

1. A centrifuge comprising:

a rotor that is configured to centrifuging a liquid sample;

a continuous sample flow passage for supplying the liquid sample to an inside of the rotor;

a drive portion that drives and rotates the rotor;

a chamber that accommodates the rotor therein, the chamber having a first penetration hole provided on an upper portion thereof and a second penetration hole provided on a bottom portion thereof;

a first valve that is disposed on the first penetration hole; and a second valve that is disposed on the second penetration hole;

means for supplying a steam to the inside of the rotor to sterilize the sample flow passage and the rotor;

a cooling gas flow passage for supplying a cooling gas to an outer periphery of the rotor;

wherein the cooling gas is introduced through one of the first and the second penetration holes and discharged through the other to cool the outer periphery of the rotor after a steam sterilization of the rotor.

2. The centrifuge according to claim 1, wherein a cooling gas or a cooling liquid is introduced into the rotor through the sample flow passage.

3. The centrifuge according to claim 1, wherein, as viewed in a rotation axis direction of the rotor, the first and the second penetration holes are separated by an angle in a range of from 90 degree to 270 degree in an angle axis direction of the rotor.

4. The centrifuge according to claim 1 further comprising:

a filter disposed on one of the first and the second valves from which the cooling gas is discharged.

5. The centrifuge according to claim 1 further comprising:

a pipe, one end of which being connected to one of the first and the second valves to introduce the cooling gas thereinto, the pipe being extended so that the other end of which is disposed outside a room in which the centrifuge is installed.

6. The centrifuge according to claim 1, wherein at least one of the first and the second valves includes a power valve; and wherein a controller that controls the power valve is provided.

7. A centrifuge comprising:

a cylindrical rotor that is rotatably supported by upper and lower rotation shafts;

a continuous sample flow passage including hollow portions of the rotation shafts for supplying a liquid sample to an inside of the rotor;

a drive portion that drives and rotates the rotor;

a chamber that accommodates the rotor therein, the chamber having a first penetration hole provided on an upper portion thereof and a second penetration hole provided on a bottom portion thereof;

means for supplying a steam to the inside of the rotor to sterilize the sample flow passage and the rotor;

means for introducing a compressed air through one of the first and the second penetration holes to a space between an outer periphery of the rotor and the chamber; and means for discharging the compressed air through the other of the first and the second penetration holes to an outside of the chamber.

8. The centrifuge according to claim 7, wherein a filter is disposed at a cooling gas discharge means.

9. The centrifuge according to claim 7, wherein, as viewed in a rotation axis direction of the rotor, the first and the second penetration holes are separated by an angle in a range of from 90 degree to 270 degree in an angle axis direction of the rotor.

* * * * *